US005770011A

United States Patent [19]

Lam et al.

[11] Patent Number: 5,770,011

[45] Date of Patent: Jun. 23, 1998

[54] NEUTRAL MONOPEROXYSULFATE BLEACHING PROCESS

[75] Inventors: Jamshed N. Lam, Monroe; Vacheslav M. Yasnovsky, Nyack; Shyam S. Bhattacharjee, Monroe, all of N.Y.

[73] Assignee: International Paper Company, Purchase, N.Y.

[21] Appl. No.: 572,147

[22] Filed: Nov. 17, 1995

[51] Int. Cl.[6] ..... D21C 9/14; D21C 9/147; D21C 9/153; D21C 9/16

[52] U.S. Cl. ..... 162/65; 162/76; 162/78; 162/89; 162/90

[58] Field of Search ..... 162/65, 78, 76, 162/88, 89, 82, 90

[56] References Cited

U.S. PATENT DOCUMENTS

| | | | |
|---|---|---|---|
| 2,901,319 | 8/1959 | D'Addieco | 162/78 |
| 3,645,840 | 2/1972 | Lincoln et al. | 162/78 |
| 4,400,237 | 8/1983 | Krüger | 162/76 |
| 4,404,061 | 9/1983 | Cael | 162/76 |
| 4,475,984 | 10/1984 | Cael | 162/76 |
| 4,756,800 | 7/1988 | Springer et al. | 162/64 |
| 4,793,898 | 12/1988 | Laamanen et al. | 162/76 |
| 5,004,523 | 4/1991 | Springer et al. | 162/76 |
| 5,091,054 | 2/1992 | Meier et al. | 162/65 |
| 5,246,543 | 9/1993 | Meier et al. | 162/65 |
| 5,346,588 | 9/1994 | Sixta et al. | 162/65 |

FOREIGN PATENT DOCUMENTS

| | | |
|---|---|---|
| 0 426 652 B1 | 5/1991 | European Pat. Off. . |
| PCT/WO92/ 21814 | 12/1992 | WIPO . |
| PCT/WO94/ 12721 | 6/1994 | WIPO . |

OTHER PUBLICATIONS

Lachenal, "The Potential of H202 as delignifying amd bleaching agent", 1992 Pacific Pulps and Paper Conf. Proceedinfgs; Sep. 8–10 1992.

"Bleaching Groundwood and Kraft Pulps with Potassium Peroxymonosulfate—Comparison with Hydrogen Peroxide"—Edward L. Springer and James D. McSweeny Published: 1986 Publishing Conference—pp. 671–681—TAPPI Proceedings.

"Delignification of Aspen Wood Using Hydrogen Peroxide and Peroxymonosulfate" Edward L. Springer Published: 1989 Contaminant Problems and Strategies in Wastepaper Recycling, pp. 125–128—TAPPI Notes.

"Delignification of Wood Fibers with Peroxymonosulfate—A Potential New Pulping Process" James L. Minor and Edward L. Springer Publication: 1989 Wood and Pulping Chemistry, pp. 133–138—TAPPI Proceeding.

"Use of Calcium Sulfite and Air to Bleach a Delignified Aspen Kraft Pulp" Edward L. Springer and James D. McSweeny Publication: TAPPI, v. 69,4, pp. 129–130—1986.

*Primary Examiner*—Steven Alvo

*Attorney, Agent, or Firm*—Luedeka, Neely & Graham, P.C.

[57] ABSTRACT

An elementally chlorine-free method for the delignification and bleaching of pulp which involves the use of a neutral monoperoxysulfate bleaching step to delignify and thus brighten the pulp. The process achieves good selectivities above about 3 even at high delignification degrees of 60% or greater.

28 Claims, 1 Drawing Sheet

NEUTRAL MONOPEROXYSULFATE BLEACHING PROCESS

FIELD OF THE INVENTION

The present invention relates to methods for bleaching lignocellulosic materials in order to prepare pulps for the manufacture of paper and, more particularly, to improve chlorine-free bleaching processes.

BACKGROUND

In the bleaching of kraft and hardwood pulps, the main objective is to brighten the pulp with a minimum of damage to the cellulose backbone of the fiber.

In the past, the most effective means for brightening pulp was the use of chlorine-containing bleaching agents. However, due to environmental concerns about chlorinated wastes, particularly dioxins from the bleaching process, the industry is moving away from chlorine-based bleaching processes in order to decrease the amount of chlorine required in the bleaching stages.

Oxygen-based bleaching procedures which are rapidly gaining popularity as substitutes for chlorine include oxygen, ozone and hydrogen peroxide. The oxygen-based bleaching procedures are currently being implemented in multi-step bleaching sequences. An oxygen delignification stage may provide up to 65% delignification on kraft and sulfite pulps. In the industry, however, most mills operate oxygen stages with delignification degrees between 40 and 45% due to a decrease in the selectivity of the reaction at higher degrees of delignification. When operating at delignification degrees above about 50%, pulp viscosity and pulp strength properties tend to drop sharply. Accordingly, the selectivity of the oxygen-based delignification agents is much lower than with chlorine-based chemicals.

One oxygen-based delignification process which has been proposed as a replacement for chlorine-based methods employs a monopersulfate or monoperoxysulfate solution as disclosed in U.S. Pat. Nos. 4,404,061 and 4,475,984 to Cael. The Cael patents describe the use of monoperoxysulfate to bleach pulp at a pH ranging from 2 to 12 and preferably 3 to 12. While Cael demonstrates that monoperoxysulfate bleaching is a viable process, he also suggests that if additional brightness is desired, various standard bleaching techniques may be applied to the monoperoxysulfate bleached pulp. Without standard bleaching techniques, attempts to gain additional brightness improvement using the Cael process typically result in a decrease in selectivity and viscosity of the resulting pulp.

Another chlorine-free treatment process is disclosed in U.S. Pat. No. 5,091,054 to Meier et al. which relates to the use of a peroxymonosulfuric acid pretreatment stage in combination with an oxygen and/or peroxide delignification stage. According to Meier et al., pretreatment with monoperoxysulfuric acid at a pH ranging from 3 to 5 achieves the optimum delignification efficiency. However, the use of peroxymonosulfuric acid at a pH ranging from 3 to 5 which is suggested by Meier et al. typically results in a reduction of delignification selectivity as indicated by the viscosity loss of the treated pulp.

It is therefore an object of the invention to provide a substantially chlorine-free delignification and bleaching process for kraft pulp.

Another object of the invention is to provide an improved chlorine-free delignification and bleaching process for kraft pulp whereby reduction in the physical properties of the pulp conventionally associated with delignification is avoided.

Still another object of the invention is to provide an improved method for elementally chlorine-free bleaching of lignocellulosic materials wherein the selectivity remains high even at high degrees of delignification.

Yet another object of the invention is to provide a method of the character described which uses readily available agents.

SUMMARY OF THE INVENTION

With regard to the above and other objects, the present invention is directed to a process for bleaching and delignifying lignocellulosic pulp such as kraft pulp. The process comprises reacting the pulp with an aqueous solution containing an alkali or alkaline earth metal salt of a monoperoxysulfuric acid while maintaining a substantially neutral pH. An advantage of the process of the present invention is that the selectivity of the treatment remains high even at delignification degrees above about 60% by weight.

The term "selectivity" is defined as a ratio of the change in Kappa number to change in viscosity as a result of the bleaching and delignification process. As is known, the Kappa number is related to the amount of lignin remaining in the pulp. As the lignin content decreases, so does the Kappa number. In general, a significant drop in the Kappa number indicates a significant bleaching effect. However, an increase in effectiveness of the bleaching agent is almost always accompanied by a decrease in pulp physical properties such as viscosity. The selectivity is a measure of the ability of a treatment to achieve a significant Kappa reduction with a minimum loss of viscosity.

The benefits of maintaining a neutral pH during monoperoxysulfate delignification and bleaching in accordance with the invention were unexpected and could not be predicted based on well known theories relating to delignification and bleaching. In particular, the high selectivity rates even at high degrees of delignification were unexpected. Accordingly, the ability to maintain high selectivity at high degrees of delignification is truly remarkable particularly for a non-chlorine based bleaching technique.

BRIEF DESCRIPTION OF THE DRAWINGS

Other benefits and advantages of the invention may be understood by reference to the figures in conjunction with the following description in which.

DETAILED DESCRIPTION OF THE INVENTION

Figure 1:
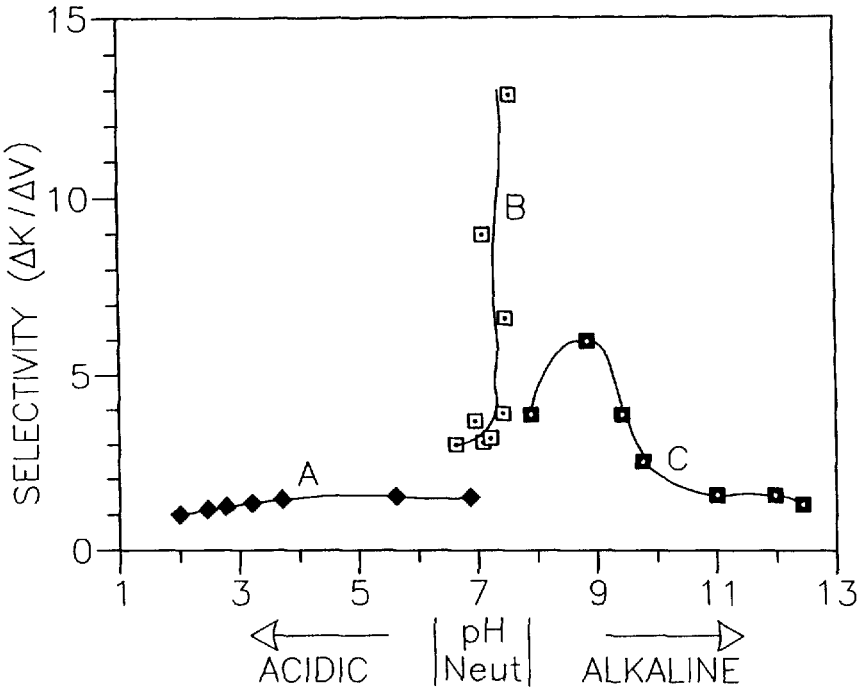
FIG. 1 is a graphical representation of delignification selectivity over a range of pH values.

With regard to the process for the delignification of a lignocellulosic pulp such as a kraft pulp, a key feature of the present invention is the use of an alkali or alkaline earth metal salt of a monoperoxysulfuric acid at a substantially neutral pH. By "substantially neutral pH" it is meant that the pH preferably ranges from about 6.5 to about 9.0, more preferably from about 6.8 to about 8.5, and most preferably from about 7.0 to about 7.6.

The alkali or alkaline earth metal salts of the monoperoxysulfuric acid may be selected from the sodium, potassium, calcium, magnesium, lithium, barium, rubidium, cesium, and strontium salts of the monoperoxysulfuric acid.

The neutral monoperoxysulfuric acid salt may be produced on site or may be purchased off site and transported to the bleaching location. One procedure which may be used to generate the reactants on site is to combine hydrogen peroxide, sulfuric acid and an alkali or alkaline earth metal carbonate, bicarbonate, oxide or hydroxide in amounts sufficient to form the neutral monoperoxysulfuric acid salt. The amount of each reactant may range from about 1 to about 2 moles hydrogen peroxide, from about 1 to about 3 moles sulfuric acid and from about 2 to about 6 moles of alkali or alkaline earth metal carbonate, bicarbonate, oxide or hydroxide depending on the amount of sulfuric acid used and the pH required. It is preferred to maintain an excess of a buffering compound in the solution, such as sodium bicarbonate in order to more easily maintain the desired pH throughout the treatment stage. Accordingly, the solution may contain as much as about 15 to about 20 wt. % buffer such as sodium bicarbonate in addition to the alkali or alkaline earth metal salt of the monoperoxysulfuric acid.

The amount of alkali or alkaline earth metal salt of monoperoxysulfuric acid used to treat the pulp is preferably within the range of from about 0.1 to about 8 wt. % (as $H_2O_2$) based on the oven dried weight of the pulp, more preferably from about 0.2 to about 5 wt. % and most preferably from about 2 to about 3 wt. %. More or less neutral monoperoxysulfuric acid salt may be used, however, the foregoing amounts are sufficient for most bleaching purposes.

Neutral monoperoxysulfuric acid salt bleaching may be conducted at temperatures ranging from about 20° to about 100° C., preferably from about 40° C. to about 80° C. and for periods of time ranging from about 30 minutes to about 3 hours or more. During the bleaching sequence, the pulp will typically have a consistency of about from 5 to about 20 wt. % or more.

A typical pulp treating sequence includes a heavy metals removal stage as generally practiced in the industry. Prior to bleaching and delignification, metals may be removed from the pulp by pretreating the pulp with chelating agents such as sodium or potassium orthophosphates, sodium or potassium pyrophosphates, nitrilotriacetic acid (NTA), ethylenediaminetetra(methylene-phosphonic) acid, ethylenediaminetetraacetic acid (EDTA), diethylenetriaminepentaacetic acid (DTPA), hydroxyethylenediaminetriacetic acid, diethylenetriaminepentamethylenephosphonic acid (DTMPA), and the alkaline metal salts thereof to name a few. The second stage of the bleaching sequence includes the neutral monoperoxysulfuric acid salt bleaching step ($P_{ns}$), and the third stage will typically be a standard alkaline extraction stage to remove the lignin. Such alkaline extraction stages include alkaline extraction (E), oxygen reinforced extraction ($E_o$) and oxygen and peroxide reinforced extraction ($E_{op}$) stages. If desired, the pulp may be further bleached to a GE brightness of 85 to 88% by an elementally chlorine-free sequence such as DED or by a totally chlorine-free sequence such as ZQP. Particularly preferred are the following bleaching sequences: $E_oP_{ns}E_oQp$, $P_{ns}E_oZQP$, $E_oQZ(Q+P_{ns})P$ and $P_{ns}E_oDED$ and variations thereof.

In order to further illustrate the advantages of the invention, the following examples are given and are not to be interpreted as limiting the invention in any manner.

EXAMPLE 1

A softwoood kraft pulp (10 grams based on oven dry weight of pulp) of Kappa number 16.1 and viscosity of 19.7 centipoise was initially treated with the disodium salt of ethylenediaminetetraacetic acid (ETDA) to remove metals. The pulp was then treated with monoperoxysulfate (2.5 wt. % as $H_2O_2$ based on the oven dried weight of wood fibers) at 10 wt. % consistency. The pulp was then washed twice with distilled water and subjected to an alkaline extraction treatment with 2.5 wt. % NaOH at 10 wt. % consistency and 80° C. for 1 hour.

In samples numbered 1–8, the bleaching step was conducted under substantially neutral pH conditions by maintaining about 12–22.5 wt. % sodium bicarbonate in the bleaching solution.

For comparison purposes, samples numbered 9–15 illustrate acidic monoperoxysulfate bleaching at a pH ranging from about 2 to just above about 7 and samples numbered 16–22 illustrate alkaline monoperoxysulfate bleaching at a pH ranging from above about 8.0 to 12.7. The results are given below in Table 1 and illustrated in FIGS. 1 and 2.

TABLE 1

| Sample # | Initial pH | Final pH | Temp. (°C.) | Time (hrs) | Kappa No. | Viscosity (cP) | Delignification (wt. %) | Selectivity (▲K/▲V) |
|---|---|---|---|---|---|---|---|---|
| Neutral | | | | | | | | |
| 1 | 7.13 | 6.78 | 50 | 3.0 | 6.07 | 16.41 | 62.37 | 3.05 |
| 2 | 7.15 | 7.00 | 50 | 3.0 | 5.47 | 16.91 | 66.10 | 3.79 |
| 3 | 7.29 | 7.15 | 50 | 2.5 | 5.92 | 16.40 | 63.30 | 3.08 |
| 4 | 7.39 | 7.28 | 50 | 2.5 | 5.77 | 16.56 | 64.24 | 3.28 |
| 5 | 7.47 | 7.44 | 50 | 2.5 | 6.07 | 17.29 | 62.37 | 4.14 |
| 6 | 7.24 | 7.13 | 50 | 2.5 | 6.07 | 18.58 | 62.37 | 8.82 |
| 7 | 8.29 | 7.57 | 50 | 2.5 | 6.52 | 18.24 | 59.58 | 6.50 |
| 8 | 8.65 | 7.65 | 50 | 2.5 | 6.37 | 18.97 | 60.51 | 13.11 |
| Acidic | | | | | | | | |
| 9 | 2.08 | 1.97 | 70 | 6.0 | 3.97 | 6.49 | 75.41 | 0.92 |
| 10 | 6.33 | 2.45 | 70 | 6.0 | 3.97 | 9.04 | 75.41 | 1.18 |
| 11 | 6.75 | 2.77 | 70 | 5.0 | 4.87 | 11.18 | 69.82 | 1.32 |
| 12 | 6.98 | 3.19 | 70 | 5.0 | 5.55 | 12.34 | 65.63 | 1.44 |
| 13 | 6.95 | 3.69 | 70 | 5.0 | 5.62 | 12.32 | 65.17 | 1.42 |
| 14 | 7.05 | 5.62 | 70 | 4.0 | 5.77 | 13.56 | 64.24 | 1.68 |
| 15 | 7.23 | 6.81 | 70 | 4.0 | 6.07 | 13.73 | 62.37 | 1.68 |
| Alkaline | | | | | | | | |
| 16 | 8.83 | 7.98 | 50 | 2.5 | 6.82 | 17.50 | 57.72 | 4.19 |

TABLE 1-continued

| Sample # | Initial pH | Final pH | Temp. (°C.) | Time (hrs) | Kappa No. | Viscosity (cP) | Delignification (wt. %) | Selectivity (▲K/▲V) |
|---|---|---|---|---|---|---|---|---|
| 17 | 9.06 | 8.61 | 50 | 2.5 | 7.13 | 18.20 | 55.86 | 5.95 |
| 18 | 9.43 | 9.36 | 50 | 2.5 | 6.52 | 17.43 | 59.58 | 4.20 |
| 19 | 12.1 | 9.8 | 50 | 2.5 | 5.77 | 15.58 | 64.25 | 2.50 |
| 20 | 12.4 | 11.1 | 50 | 2.5 | 4.87 | 12.11 | 69.83 | 1.48 |
| 21 | 12.6 | 12.0 | 50 | 2.5 | 4.72 | 11.24 | 70.76 | 1.35 |
| 22 | 12.7 | 12.5 | 50 | 2.5 | 4.57 | 9.78 | 71.69 | 1.16 |

As illustrated in Table 1, the selectivity has neutral monoperoxysulfate bleaching is significantly higher than the selectivity for ether acidic or alkaline monoperoxysulfate bleaching at similar delignification degrees. The relatively high selectivities of samples 16–18 under alkaline conditions are achieved only at lower delignification degrees. The improvements in delignification degree and selectivity for neutral monoperoxysulfate bleaching are obtained with relatively negligible pulp viscosity decrease as illustrated by Samples 1–8 compared to Samples 9–22.

As shown in FIG. 1, there is a selectivity spike around pH 7 as illustrated by curve B and much lower selectivities at pH values above and below 7 as illustrated by curves A and C.

Figure 2:
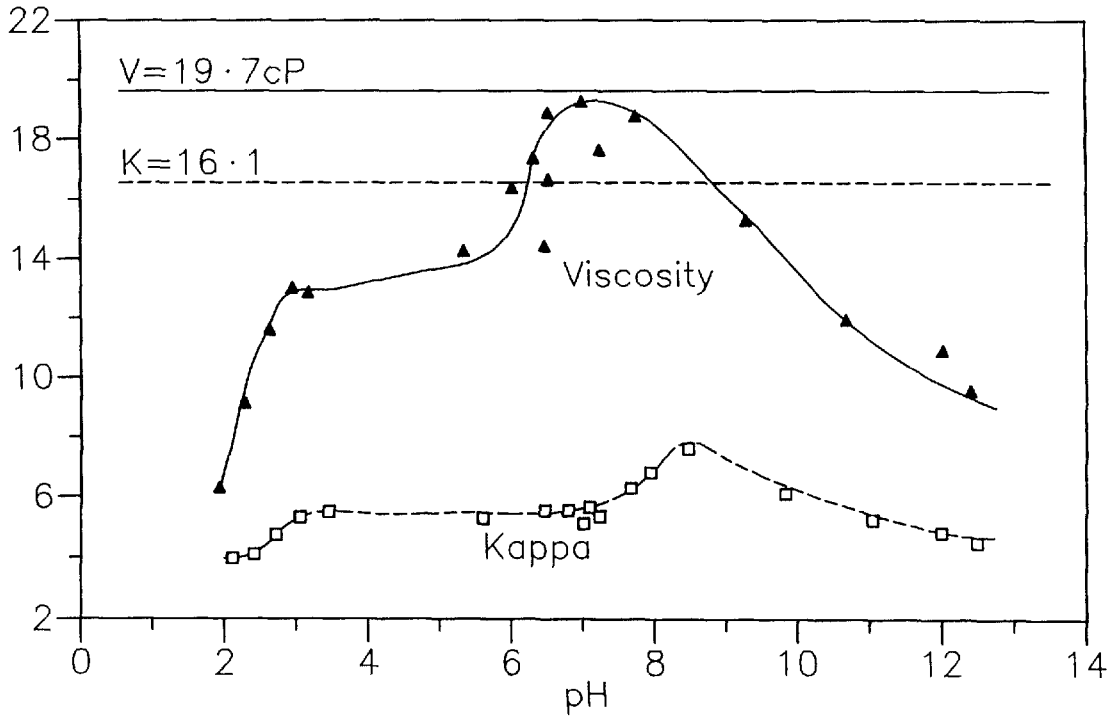
FIG. 2 is a graphical representation of how the pH of the pulp during treatment with a salt of a monoperoxy sulfuric acid affects the Kappa number and the viscosity of pulp over a range of pH values.

FIG. 2 illustrates the affect the treatment pH has on the Kappa number and viscosity of the pulp over a pH range of 2 to 14. There is a negligible loss in viscosity between pH 7 to 9. Between pH 8 to 9 the reactivity is somewhat lower resulting in a small change in Kappa number. Under acidic conditions, the reactivity is also lower and hence higher temperatures are required which also lead to a loss in viscosity. Likewise, at higher pH values, the viscosity and selectivity are lower.

EXAMPLE 2

In the next series of samples, the effect of the strength of neutral monoperoxysulfate on pulp is illustrated. For this example, the pulp was again a softwood kraft pulp having an initial Kappa number of 17.5 and an initial viscosity of 20.95 centipoise. The bleaching stage ($P_{ns}$) was conducted at an initial pH of about 7.3 and a final pH of about 7.1 at 50° C. and at 10 wt. % consistency followed by an oxygen reinforced extraction stage using 2.5 wt. % NaOH and 0.13 wt. % $MgSO_4$ at a temperature of 80° C. for 1 hour and at 10 wt. % consistency. The oxygen pressure during the extraction stage was initially 74.7 psia and was incrementally decreased (10 psi/10 min.) to 14.7 psia over the 1 hour extraction period. The results of this test are given in Table 2. In Sample 1, no monoperoxysulfate was used.

TABLE 2

| Sample # | $P_{ns}$ as $H_2O_2$ (wt. %)[1] | Kappa No. | Viscosity (cP) | Delignification (wt. %) | Selectivity (▲K/▲V) |
|---|---|---|---|---|---|
| 1 | — | 11.71 | 18.23 | 33.09 | 2.13 |
| 2 | 0.50 | 8.78 | 18.80 | 49.83 | 4.06 |
| 3 | 0.75 | 7.65 | 18.36 | 56.29 | 3.80 |
| 4 | 1.00 | 7.28 | 18.70 | 58.40 | 4.54 |

[1]The weight percent is based on the oven dried weight of wood fibers.

As illustrated in Table 2, as the amount of monoperoxysulfate is increased, there is an increase in the degree of delignification. The selectivity remains good when a neutral pH is maintained throughout the bleaching stage even at high degrees of delignification. As the degree of delignification is intensified, the selectivity increases at the neutral pH, a result which was totally unexpected.

In accordance with the present invention, neutral monoperoxysulfate bleaching, even at relatively low monoperoxysulfate concentrations, may achieve high degrees of delignification with high selectivities when used in combination with an oxygen delignification stage. To achieve the same degree of delignification with the process of U.S. Pat. No. 5,091,054 typically requires much higher oxone concentrations.

While the foregoing description and examples relate particularly to chlorine-free bleaching stages, any combination of chlorine containing and neutral monoperoxysulfate bleaching stages may also be used. Accordingly, variations of the invention by those skilled in the art are within the spirit and scope of the appended claims.

What is claimed is:

1. A process for bleaching and delignifying pulp which comprises reacting a lignocellulosic pulp prior to an alkaline extraction, oxygen delignification or chlorine-free bleaching stage in a monoperoxysulfate treatment stage wherein the pulp is contacted with an aqueous solution containing an alkali or alkaline earth metal salt of a monoperoxysulfuric acid at an initial pH in the range of from about 6.8 to about 8.5 in the presence of a buffering compound sufficient to maintain the pulp within the aforementioned range throughout the treatment stage and to bring the pulp to a final pH in the range of from about 6.8 to about 7.7 at the completion of the stage and wherein the pulp exhibits a selectivity of a least about 3 after an alkaline extraction trearment stage carried out on the pulp following the monoperoxysulfate treatment stage.

2. The process of claim 1 wherein the salt of a monoperoxysulfuric acid is formed by reacting hydrogen peroxide with sulfuric acid, and an alkali metal carbonate or hydroxide selected from the group consisting essentially of sodium hydroxide, potassium hydroxide, sodium carbonate, and sodium bicarbonate.

3. The process of claim 1 wherein the pulp is reacted with the salt for from about 30 minutes to about 3 hours.

4. The process of claim 1 wherein the selectivity is above about 3.0 even at delignification rates of about 60% or greater.

5. The process of claim 1 wherein the amount of monoperoxysulfuric acid salt ranges from about 0.2 to about 5.0 wt. %, measured as hydrogen peroxide.

6. The process of claim 1 wherein the pulp is reacted at a temperature within the range of from about 20° to about 80° C.

7. The process of claim 1 further comprising pretreating the pulp with a chelating agent to remove metals prior to the reaction.

8. The process of claim 1 wherein the consistency of the pulp during the reaction is from about 5 to about 20 wt. %.

9. A method for delignifying and bleaching a lignocellulosic pulp comprising treating the pulp prior to an alkaline extration, oxygen delignification or chlorine-free bleaching stage in a treatment sequence wherein the pulp is treated in a first step with a chelating agent to remove metals and in a second step with an aqueous solution containing an alkaline earth metal salt of monoperoxysulfuric acid at an initial pH in the range of from about 6.8 to about 8.5 in the presence of a buffering compound sufficient to maintain the pulp within the aforementioned range throughout the second step and to bring the pulp to a final pH in the range from about 6.8 to about 7.7 at the completion of the second step wherein the second step is conducted for a period of time and under conditions sufficient to obtain a delignification of the pulp of greater than about 60 wt.% wherein the pulp exhibits a selectivity of at least about 3.0 after an alkaline extraction stage carried out on the pulp following the monoperoxysulfate treatment stage.

10. The method of claim 9 wherein the salt of a monoperoxysulfuric acid is provided by reacting hydrogen peroxide with sulfuric acid and an alkali metal carbonate or hydroxide selected from the group consisting essentially of sodium hydroxide, potassium hydroxide, sodium carbonate, and sodium bicarbonate.

11. The method of claim 9 wherein the pulp/monoperoxysulfate salt reaction is carried out for from about 30 minutes to about 3 hours.

12. The method of claim 9 wherein the amount of monoperoxysulfuric acid salt ranges from about 0.2 to about 5.0 wt. %, measured as hydrogen peroxide.

13. The method of claim 9 wherein the pulp is bleached and delignified at a temperature within the range of from about 20° to about 80° C.

14. A delignifying and bleaching process for lignocellulosic pulp comprising treating the pulp prior to an alkaline extraction, oxygen delignification or chlorine-free bleaching stage in a monoperoxysulfate treatment stage with a sodium salt of a monoperoxysulfate acid at an initial pH in the range of from about 6.8 to about 8.5 in the presence of a buffering compound sufficient to maintain the pulp within the aforementioned range throughout the stage and to bring the pulp to a final pH in the range of from about 6.8 to about 7.7 at the completion of the stage and wherein the treatment stage is conducted at a temperature within the range of from about 10°to about 110° C. for a time sufficient to delignify the pulp to at least about 60 % delignification wherein the pulp exhibits a selectivity of at least about 3 after an alkaline extraction stage carried out on the pulp following the monoperoxysulfate treatment stage.

15. The process of claim 14 wherein the salt of a monoperoxysulfuric acid is provided by reacting hydrogen peroxide with sulfuric acid and an alkali metal carbonate or hydroxide selected from the group consisting essentially of sodium hydroxide, potassium hydroxide, sodium carbonate, and sodium bicarbonate.

16. The process of claim 14 wherein the pulp is treated with the salt for from about 30 minutes to about 3 hours.

17. The process of claim 14 wherein the amount of monoperoxysulfuric acid salt ranges from about 0.2 to about 5.0 wt. %, measured as hydrogen peroxide.

18. The process of claim 14 wherein the pulp is treated at a temperature within the range of from about 20° to about 80° C.

19. The process of claim 14 further comprising pretreating the pulp with a chelating agent to remove metals prior to the treatment process.

20. The process of claim 14 wherein the consistency of the pulp during the treatment process is from about 5 to about 20 wt. %.

21. A kraft pulp bleaching sequence comprising the following stages:

a monoperoxysulfuric acid salt stage ($P_{ns}$) having an initial pH in the range of from about 6.8 to about 8.5 wherein the stage contains a buffering compound sufficient to maintain the pulp within the aforementioned stage throughout the stage and to bring the pulp to a final pH in the range of from about 6.8 to about 7.7 at the completion of the stage followed by;

an extraction stage (E) wherein the pulp exhibits a selectivity of at least about 3 after the extraction stage; and a chlorine free bleaching stage.

22. The bleaching sequence of claim 21 further comprising a pretreatment stage for metals removal before the $P_{ns}$ of stage.

23. The bleaching sequence of claim 21 wherein the salt of a monoperoxysulfuric acid is an alkali metal selected from the group consisting essentially of sodium and potassium.

24. The bleaching sequence of claim 21 wherein the chlorine free bleaching stage is a chlorine dioxide stage ($D_oED_1$).

25. The bleaching sequence of claim 24 wherein the extraction stage is selected from an alkaline extraction stage (E), an oxygen reinforced extraction stage ($E_o$) and an oxygen and peroxide reinforced extraction stage ($E_{op}$).

26. The bleaching sequence of claim 21 wherein the chlorine free bleaching stage is an ozone-chelation-peroxide bleaching stage (ZQP).

27. The bleaching sequence of claim 26 wherein the extraction stage is selected from an alkaline extraction stage (E), an oxygen reinforced extraction stage ($E_o$) and an oxygen and peroxide reinforced extraction stage ($E_{op}$).

28. The bleaching sequence of claim 21 wherein the extraction stage is selected from an alkaline extraction stage (E), an oxygen reinforced extraction stage ($E_o$) and an oxygen and peroxide reinforced extraction stage ($E_{op}$).

* * * * *